US007967175B2

(12) United States Patent
Bass et al.

(10) Patent No.: US 7,967,175 B2
(45) Date of Patent: Jun. 28, 2011

(54) BACKPACK SUSPENSION SYSTEM WITH HUB

(75) Inventors: Gregory Bass, Emeryville, CA (US); Yusuke Miyashita, Menlo Park, CA (US); Tae Kim, San Francisco, CA (US)

(73) Assignee: The North Face Apparel Corp., Wilmington, DE (US)

( * ) Notice: Subject to any disclaimer, the term of this patent is extended or adjusted under 35 U.S.C. 154(b) by 747 days.

(21) Appl. No.: 11/987,337

(22) Filed: Nov. 29, 2007

(65) Prior Publication Data

US 2008/0203128 A1 Aug. 28, 2008

Related U.S. Application Data

(60) Provisional application No. 60/861,416, filed on Nov. 29, 2006.

(51) Int. Cl.
*A45F 3/10* (2006.01)

(52) U.S. Cl. ..... 224/634

(58) Field of Classification Search ..... 224/633, 224/634, 153, 154, 155; D3/216, 217; 297/16.1, 297/16.2; *A45F 3/08, 3/10*
See application file for complete search history.

(56) References Cited

U.S. PATENT DOCUMENTS

| | | | |
|---|---|---|---|
| 122,522 | A | 1/1872 | Hoffman |
| 1,040,413 | A | 10/1912 | Renard |
| 2,313,553 | A | 3/1943 | Johansen |
| 3,355,075 | A | 11/1967 | Dean |
| 3,563,431 | A | 2/1971 | Pletz |
| 3,831,827 | A | 8/1974 | Olson |
| 3,840,162 | A | 10/1974 | Horenstein |
| 3,885,722 | A | 5/1975 | Robertson |
| 3,912,138 | A | 10/1975 | Pava |
| 3,923,216 | A | 12/1975 | Farnbach |
| 4,013,201 | A | 3/1977 | Potter |
| 4,015,759 | A | 4/1977 | Dreissigacker |
| 4,040,548 | A | 8/1977 | Guglielmo |
| 4,049,164 | A | 9/1977 | Sullivan |
| 4,074,839 | A | 2/1978 | Wood |
| 4,099,657 | A | 7/1978 | Zufich |
| 4,114,788 | A | 9/1978 | Zufich |
| 4,133,464 | A | 1/1979 | Kelty |
| 4,154,381 | A | 5/1979 | Zufich |
| 4,189,076 | A | 2/1980 | Zufich |
| 4,194,656 | A | 3/1980 | Zufich |
| 4,214,685 | A | 7/1980 | Pletz |
| 4,248,367 | A | 2/1981 | Buel |
| 4,303,186 | A | 12/1981 | Ollinger |
| 4,361,259 | A | 11/1982 | Chanter |
| 4,369,903 | A | 1/1983 | Wilkes |

(Continued)

FOREIGN PATENT DOCUMENTS

WO WO 2005117641 A1 * 12/2005

*Primary Examiner* — Justin M Larson
(74) *Attorney, Agent, or Firm* — Kenyon & Kenyon

(57) ABSTRACT

A backpack suspension system is provided that provides a more natural feel as it is able to match a hiker's twisting and bending motions. A backpack suspension system comprises a frame having an upper and a lower portion, and a hub connecting the upper and lower portion. The upper and lower portion comprise a plurality of rods adapted to rotate within the hub. The hub is adapted to pivot about a horizontal axis. In certain embodiments the frame is substantially X shaped and in certain embodiments the hub is substantially X shaped.

29 Claims, 14 Drawing Sheets

U.S. PATENT DOCUMENTS 4,416,403 A 11/1983 Johnson
4,479,595 A 10/1984 Opsal
4,504,002 A 3/1985 Hall
4,676,418 A 6/1987 Lowe
4,911,346 A 3/1990 Shallman
4,982,884 A 1/1991 Wise
5,114,059 A 5/1992 Thatcher
5,161,722 A 11/1992 Hembree
5,184,763 A 2/1993 Blaisdell
5,184,764 A 2/1993 Orovan
5,236,112 A 8/1993 Robinson
5,341,974 A 8/1994 Robinson
5,503,314 A 4/1996 Fiscus
5,560,502 A * 10/1996 Hsiung ..... 211/195
5,609,278 A 3/1997 Fresco
5,704,530 A 1/1998 Scherer
5,762,243 A 6/1998 McMaster
5,806,740 A 9/1998 Carlson
5,836,489 A 11/1998 Swetish
5,890,640 A 4/1999 Thompson
5,954,250 A 9/1999 Hall
5,954,253 A 9/1999 Swetish
5,971,244 A 10/1999 Jaeger
5,984,157 A 11/1999 Swetish
6,015,076 A 1/2000 Pennington
6,158,641 A 12/2000 Eyman
6,199,732 B1 3/2001 Swetish
6,276,584 B1 8/2001 McLachlan
6,290,111 B1 9/2001 Hedenberg
6,457,620 B1 10/2002 Batten
6,502,732 B1 1/2003 Bonds
6,547,110 B2 4/2003 O'Hare
6,607,107 B2 8/2003 Dexheimer
6,607,108 B2 8/2003 Mydans
6,626,342 B1 9/2003 Gleason
6,848,120 B2 2/2005 Kling
7,185,861 B2 * 3/2007 LaMotte ..... 248/165
2003/0127483 A1 7/2003 Black
2005/0092802 A1 5/2005 Maley
2005/0099039 A1 * 5/2005 Rhee ..... 297/129
2005/0121484 A1 6/2005 Meyer
2006/0163305 A1 7/2006 Tong
2006/0191969 A1 8/2006 Goulding
2006/0208024 A1 9/2006 Gleason, Jr.

* cited by examiner

BACKPACK SUSPENSION SYSTEM WITH HUB

RELATED APPLICATIONS

This application claims the benefit of U.S. Provisional Application No. 60/861,416, filed Nov. 29, 2006, the entire contents of which are hereby incorporated by reference.

BACKGROUND OF THE INVENTION

Internal frame backpacks, which have a frame structure integrated into the inside of the backpack, have been around for some time and are routinely used by hikers and mountaineers. The backpack frame may be lightweight yet strong enough to withstand the weight of the load as well as withstand being sat on or leaned up against, as can routinely happen during long and arduous expeditions. However, such frames are often rigid and thus provide no torsional flexibility to permit the backpack frame to flex and move along with the user.

In the past, backpack manufacturers have attempted to address this issue by designing frames or backpacks that permit a twisting motion or backward/forward motion. However, when the user hikes, especially on a incline or decline, the shoulders rotate and the spine bends forward and backward, while the hips rotate and move up and down with each step, thus producing more than a simple twisting or backward/forward motion. Since the backpack frame does not provide movement/flexibility to match the "dynamic motion" of the hiker, the user experiences strain, discomfort and fatigue as the user must use core muscles in the back and abdomen to stabilize the body and counteract the flopping/mismatched movement of the backpack. Thus, there remains a need for a backpack suspension system that allows "dynamic motion" to match that of the user's body motion. Embodiments of the present invention fulfill this need.

BRIEF SUMMARY OF THE INVENTION

The present invention relates to a backpack suspension system. The system reduces fatigue and strain on the user and provides flexibility making the backpack feel more natural as the wearer moves. A backpack suspension system of the present invention comprises a frame having an upper and a lower portion, and a hub connecting the upper and lower portion. The upper and lower portion comprise a plurality of rods adapted to rotate within the hub. The hub is adapted to pivot around a horizontal axis. In certain embodiments the hub is substantially X shaped and in certain embodiments the frame is substantially X shaped.

The hub is preferably substantially centrally located between the upper and lower portions of the frame. The plurality of rods preferably have a linear profile and a curved profile, where the curved profile mimics the curvature of a human spine. The backpack suspension system also optionally further comprises a head piece and a connector that connects the plurality of rods of the upper portion to a head piece. In certain embodiments, the connector piece further comprises a support member.

To allow the hub to pivot along a horizontal axis, the hub is preferably comprised of two members mated together with a pin, which allows pivoting of said two members around a longitudinal axis of the pin. The pin is preferably slip fitted to provide rotation of the hub around the pin.

The present invention further provides a backpack comprising a backpack suspension system. The backpack may further comprise a bag portion, a plurality of shoulder straps each attached to the bag portion, and a hip belt attached to the bag portion.

DETAILED DESCRIPTION OF THE INVENTION

Figures 2A, 2B:
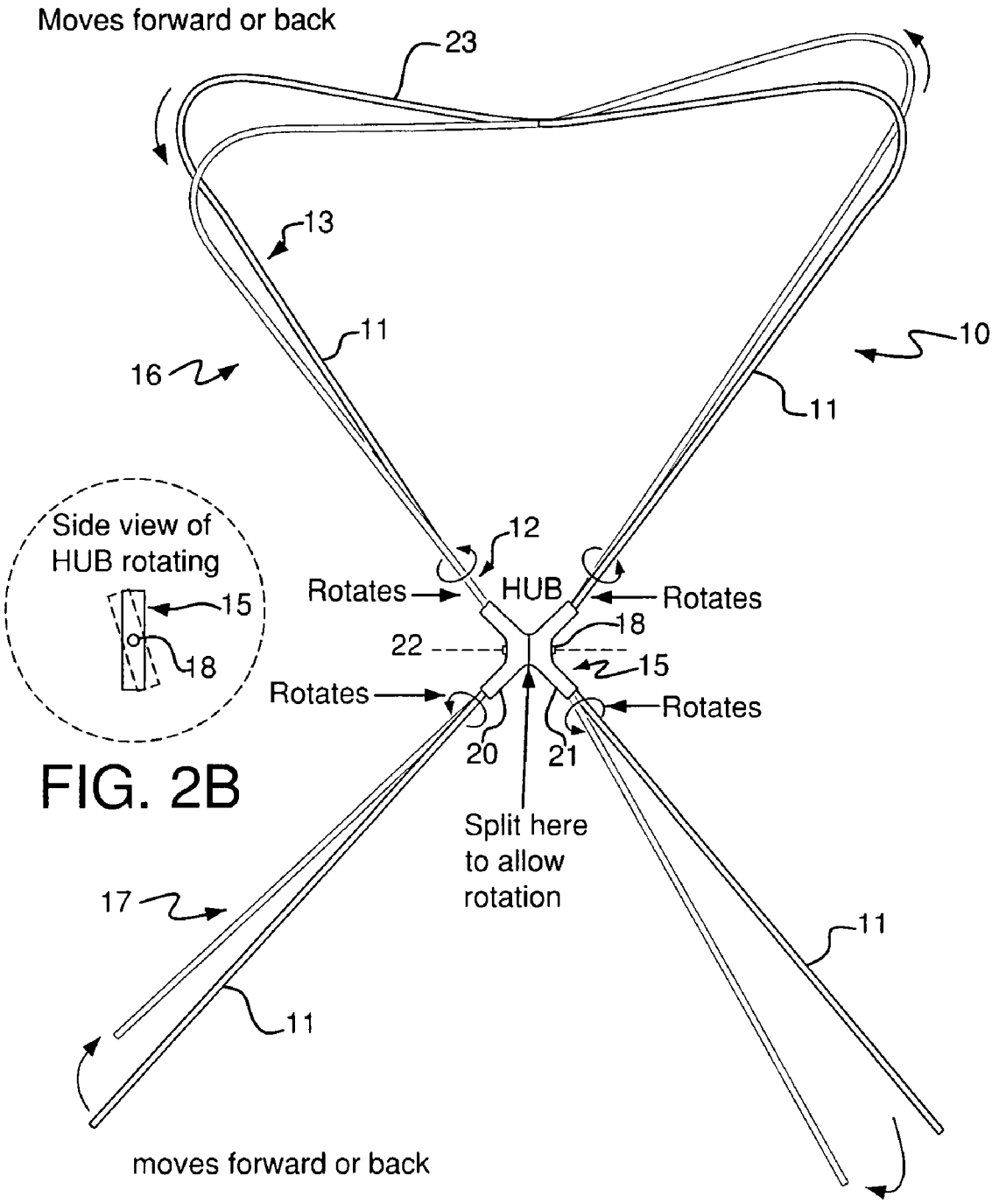
FIG. 2*a* is a perspective view of one embodiment of the invention showing a hub that pivots in a vertical plane (around a horizontal axis) and rods that rotate within the hub.
FIG. 2*b* provides a side view of the hub rotating/pivoting around the horizontal axis.

Referring to FIG. 2*a*, a backpack suspension system comprises a frame 10 having an upper portion 16 and a lower portion 17, and a substantially X shaped hub 15 that connects the upper and lower portion of the frame. The upper and lower portions comprise a plurality of rods 11. Each rod has a proximal end 12 and a distal end 13. Each proximal end of the plurality of rods is adapted to rotate within a hub, thus providing four different axes of rotation (the proximal end of four rods around the longitudinal axis). The backpack suspension system has an optional head piece 23. In certain embodiments, the hub 15 is centrally located between the upper and lower portion of the frame of the backpack suspension system.

Figure 3C:
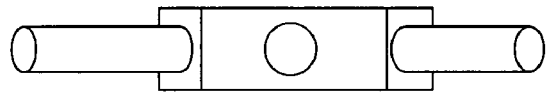
FIGS. 3A and 3C show side views of a hub.
Figure 3B:
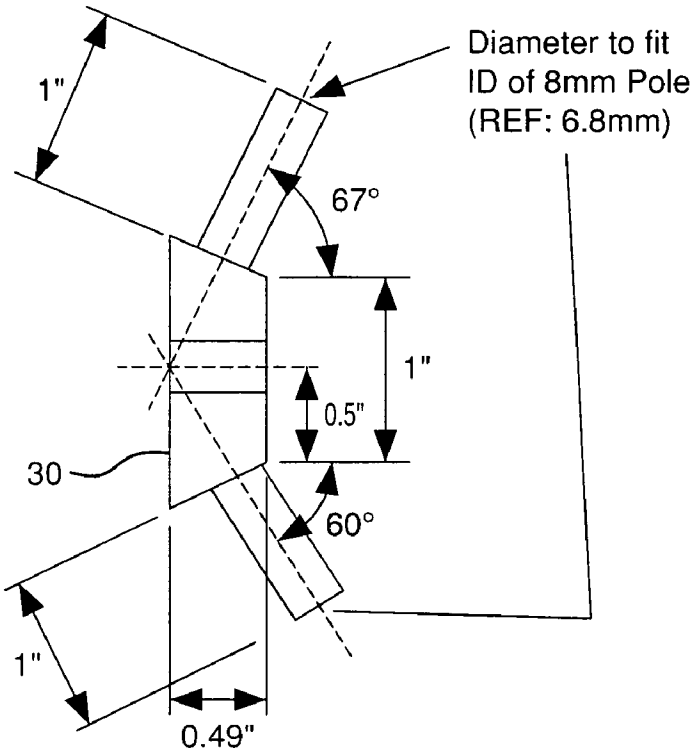
FIG. 3B provides a front view of the hub shown in FIGS. 3A and 3C.
Figure 3A:
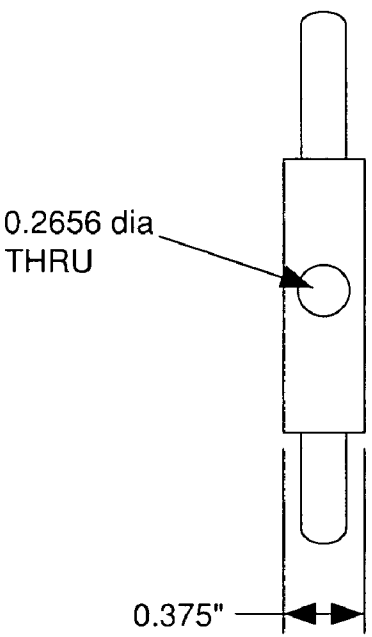

In a preferred embodiment, the hub is comprised of a first member 20 and a second member 21 connected together with a pin 18 to allow the hub to pivot around a horizontal axis. The hub 15 is adapted to pivot around a horizontal axis 22. FIG. 3*b* provides an exemplary hub of the present invention. A first member 30 of the hub is shown with exemplary dimensions, angles and measurements. FIGS. 3A and 3C show a side view of a hub with an opening that allows for a pin to be inserted and which provides the axis around which the hub rotates.

Figure 1:
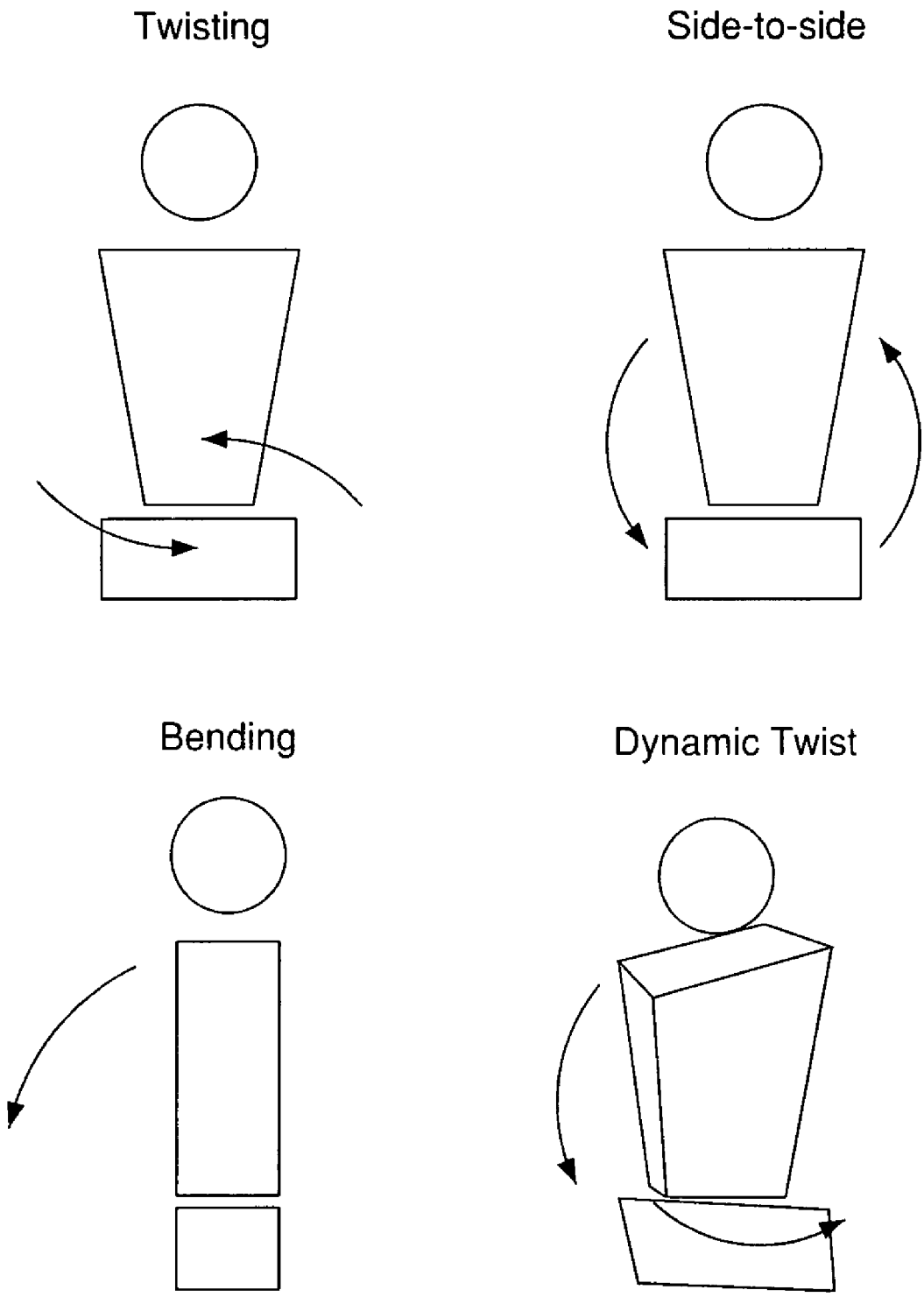
FIG. 1 shows diagrams of the different types of movement the human body makes.

The rotation of the proximal end of a plurality of rods within a hub, which provides four different axes of rotation, combined with a fifth different axis of rotation, i.e., the pivoting motion of the hub, results in a more natural feeling backpack as it allows "dynamic motion" (as seen in FIG. 1) corresponding to the user's natural body movements. A "dyanamic twist" or "dynamic motion" occurs when the shoulders of a hiker or mountaineer turn opposite of the hips and when the spine bends to some degree.

One skilled in the art would appreciate that a plurality of rods may be fabricated of any suitable material. Ideally the material is lightweight, strong and durable and can withstand extreme temperatures often encountered while hiking and mountaineering. Exemplary materials include, but are not limited to tubular aluminum and titanium as they fulfill these criteria. In one embodiment, a preferable aluminum is 7001 T6 aluminum.

The plurality of rods may have any outer or inner diameter necessary to provide support, based on the material used in the rods. As a non-limiting example, if the rods are comprised of tubular aluminum, in certain embodiments, the rods may range from about 6 mm to about 18 mm. Preferably the plurality of rods are also sized to fit into the hub to provide rotation within the hub.

The plurality of rods may be sized to accommodate a backpack's size and a user's torso length. For example, packs typically range in size from summit packs to voluminous expedition packs. Obviously an expedition pack would typically be larger in length, width and carrying capacity as compared to a summit or day pack. Also, the rods may be sized to accommodate various torso lengths to provide optimum comfort for the user.

The hub is preferably made of a material that is lightweight, strong and durable and can withstand extreme temperatures often encountered while hiking and mountaineering. Exemplary hub materials include, but are not limited to, aluminum, titanium, plastic, and nylon reinforced with glass. In a preferred embodiment, the hub is comprised of nylon reinforced with glass, comprising no less than about 20% glass.

As discussed above, a hub is adapted to pivot around a horizontal axis. Any design that allows for pivoting around a horizontal axis is contemplated in the present invention. In a preferred embodiment, a hub is comprised of a rigid material and is also comprised of a first member 20 and a second member 21 mated together with a pin 18 to allow the hub to pivot around the horizontal axis. See FIG. 2. The pin is preferably slip fitted within the hub to allow the pivoting motion. The pin may be of any material that is durable and would hold up over time against torque stresses and friction between the pin and the hub. Exemplary materials include, but are not limited to aluminum, stainless steel, fiberglass, reinforced plastic and titanium. The pin may be a screw or any other rod shaped device.

Figure 8A:
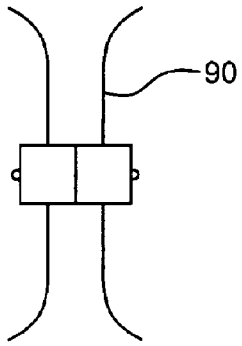
FIG. 8*a*-8*d* provides front views of exemplary rods of the backpack suspension system.
Figure 8B:
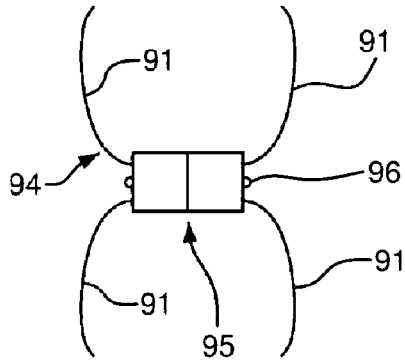
Figure 8C:
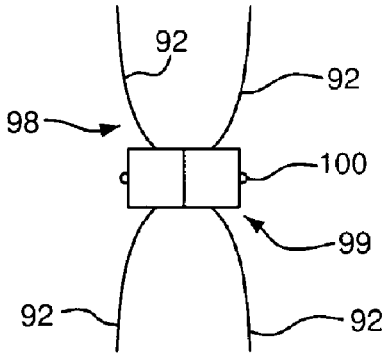
Figure 8D:
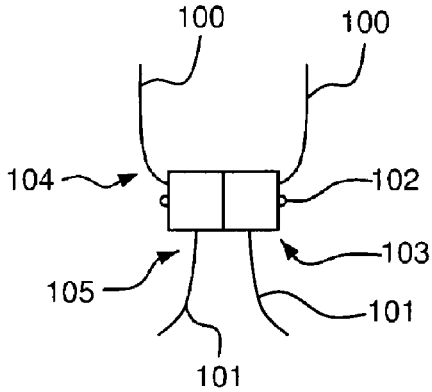
Figure 9A:
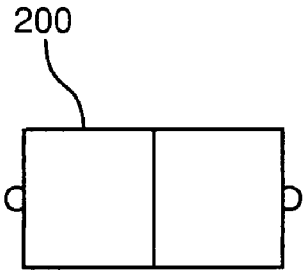
FIG. 9*a*-9*e* shows front views of exemplary hubs of the backpack suspension system.
Figure 9B:
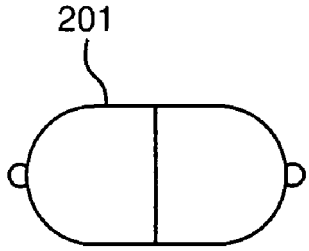
Figure 9C:
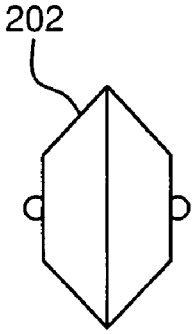
Figure 9D:
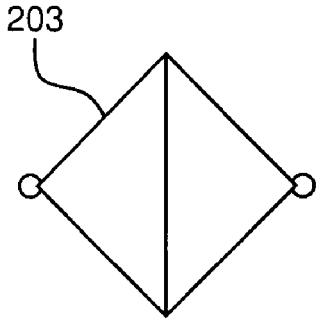
Figure 9E:
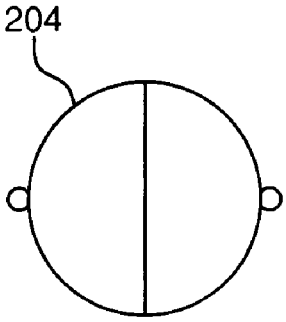
Figure 10:
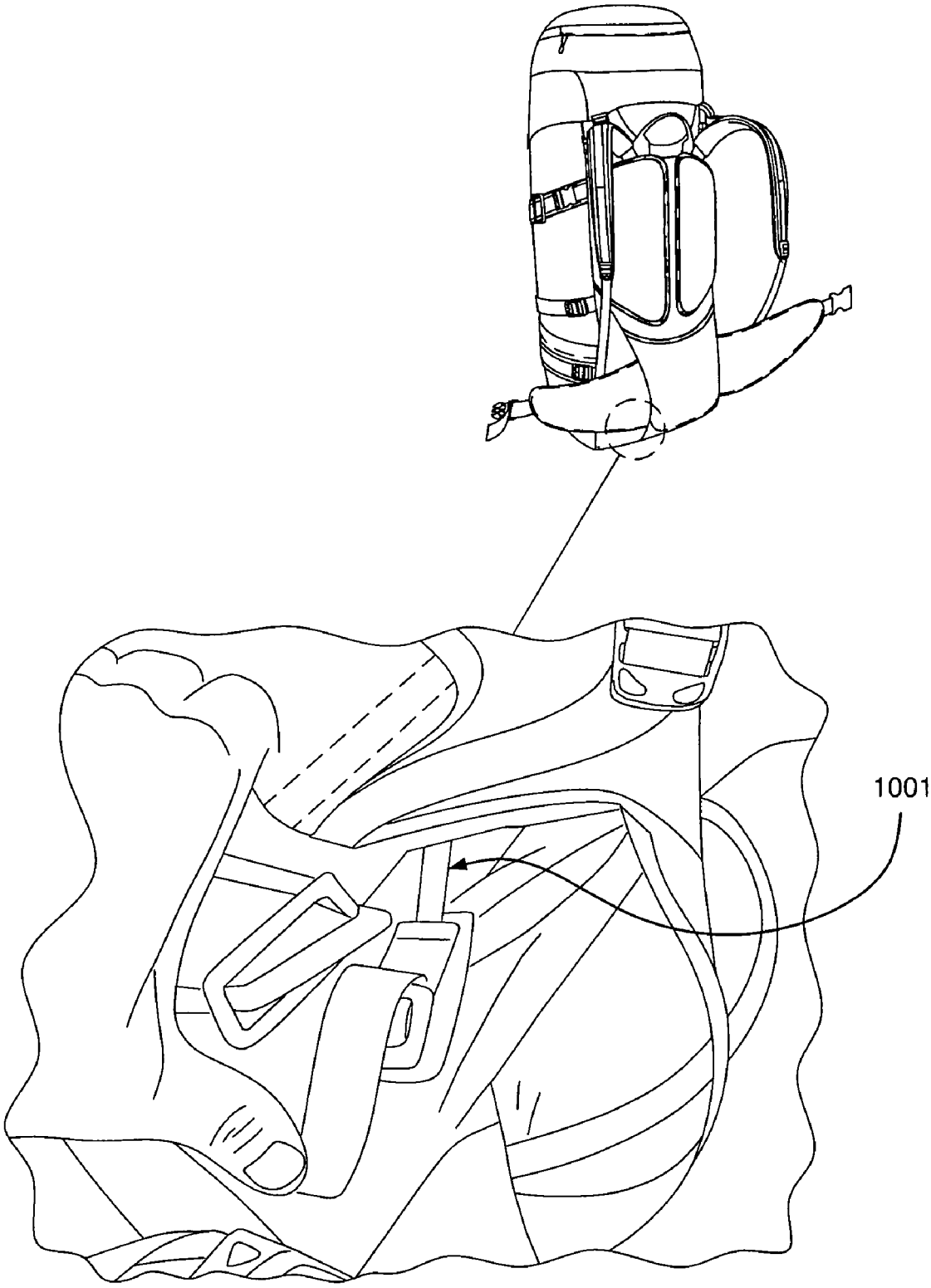
FIG. 10 shows an exemplary backpack comprising a backpack suspension system attached to the lower portion of the backpack.
Figure 11:
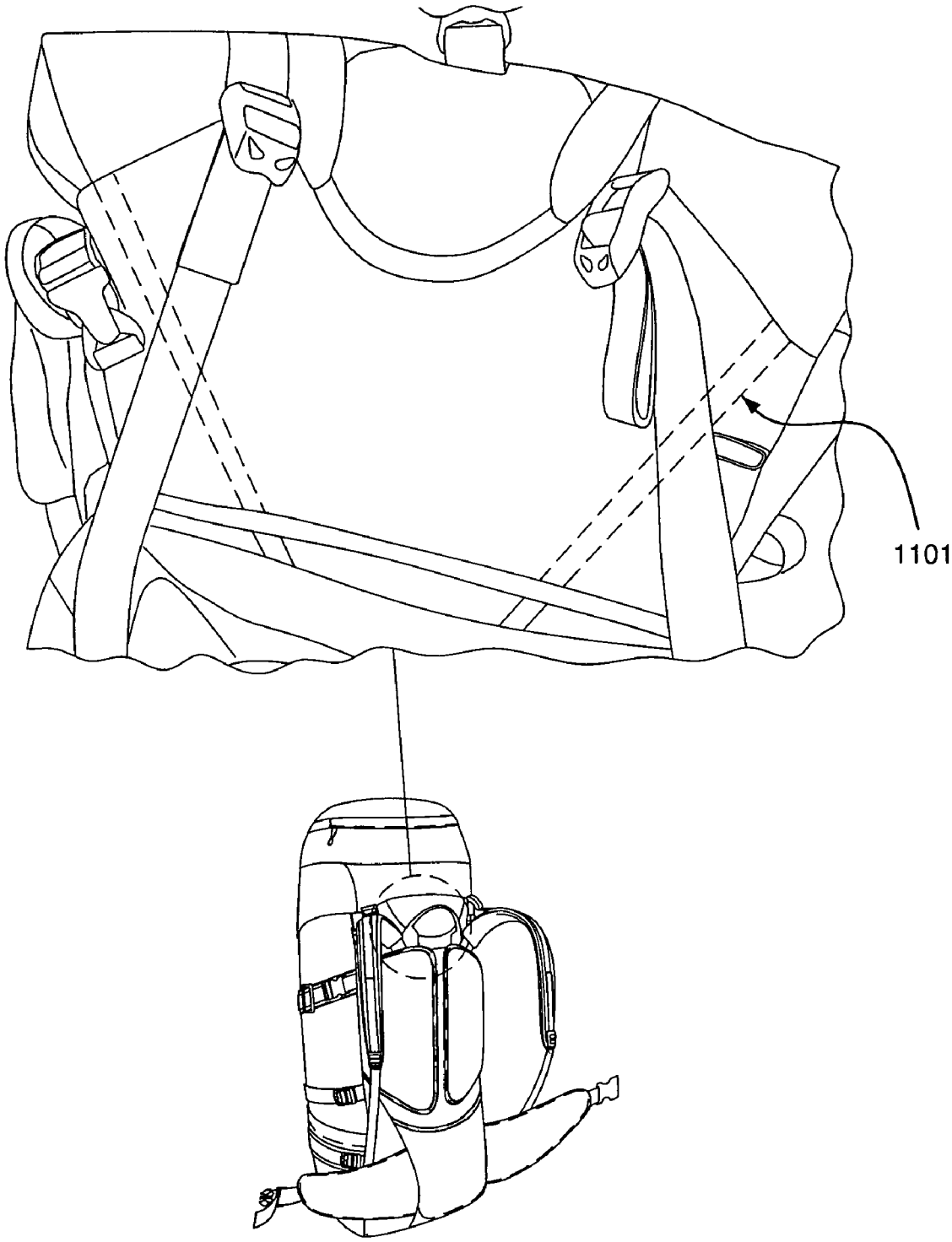
FIG. 11 shows an exemplary backpack comprising a backpack suspension system attached to the upper portion of the backpack.
Figure 12:
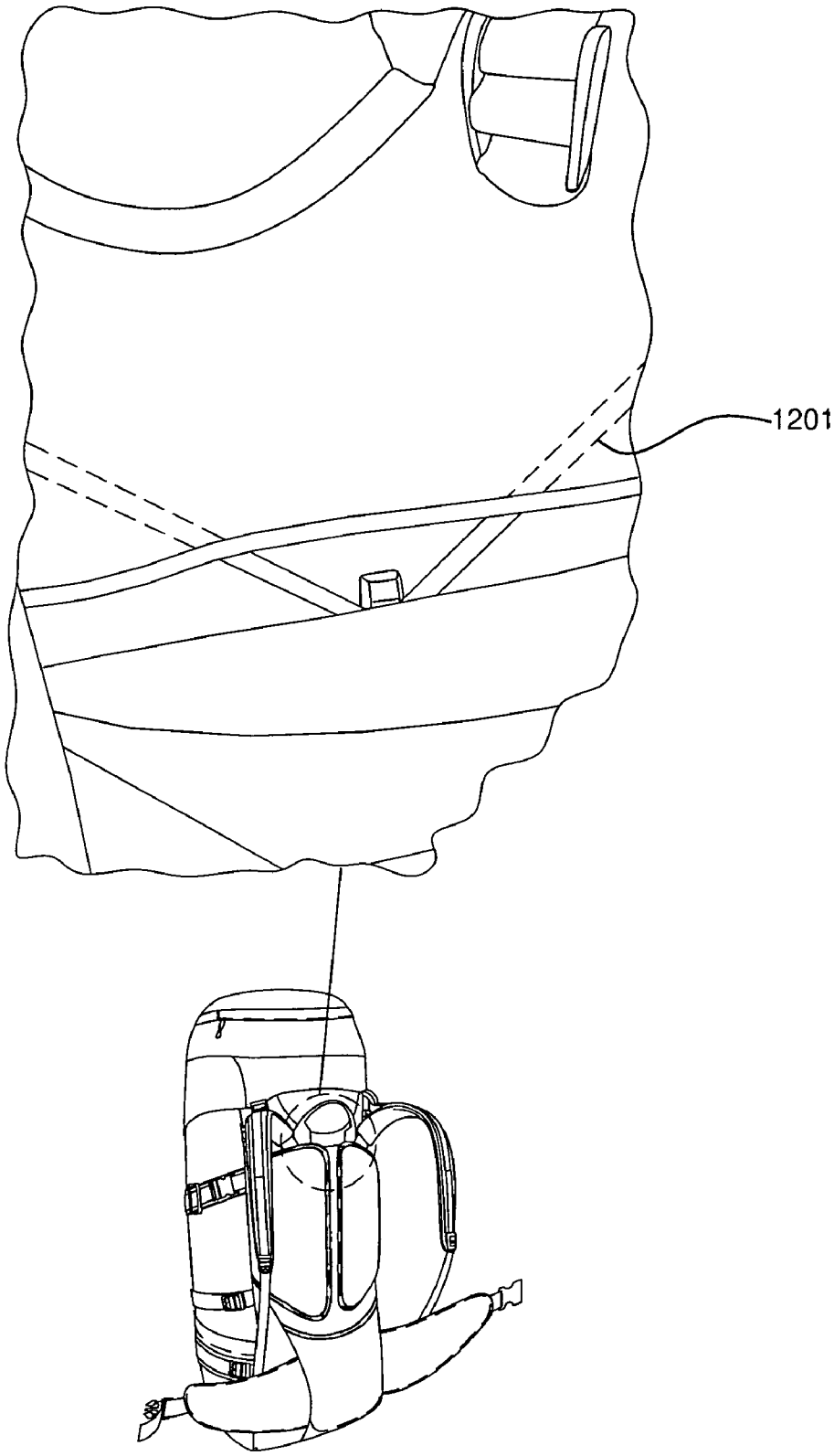
FIG. 12 shows a middle portion of an exemplary backpack comprising a backpack suspension system.
Figure 13:
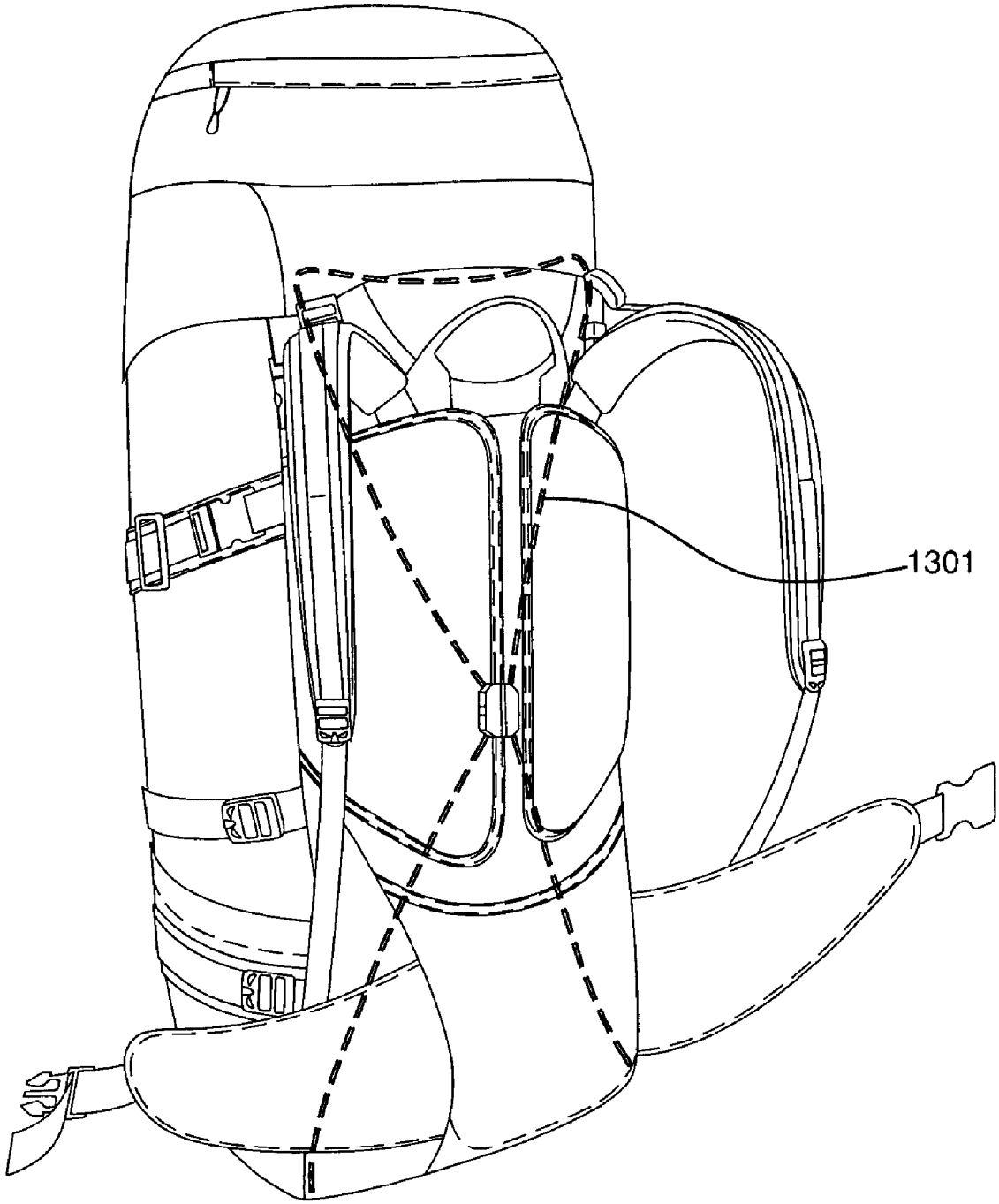
FIG. 13 shows an exemplary backpack with a backpack suspension system superimposed on the backpack.

The plurality of rods may be connected to any suitable face of the hub, as long as the plurality of rods are capable of rotating within the hub. For example, referring to FIG. 8*b*, a proximal end 94 of a plurality of rods 91 are connected to a hub 95 on the face of the hub that also contains a pin 96. Referring to FIG. 8*c*, a proximal end 98 of a plurality of rods 92 are connected to a hub 99 on a face that does not contain a pin 100. Referring to FIG. 8*d*, a proximal end 104 of a plurality of rods 100 may be connected to a hub 103 on the face that contains a pin 102 while a proximal end 105 of a plurality of rods 101 may be connected to a hub 103 on the face that does not contain a pin.

Figure 4:
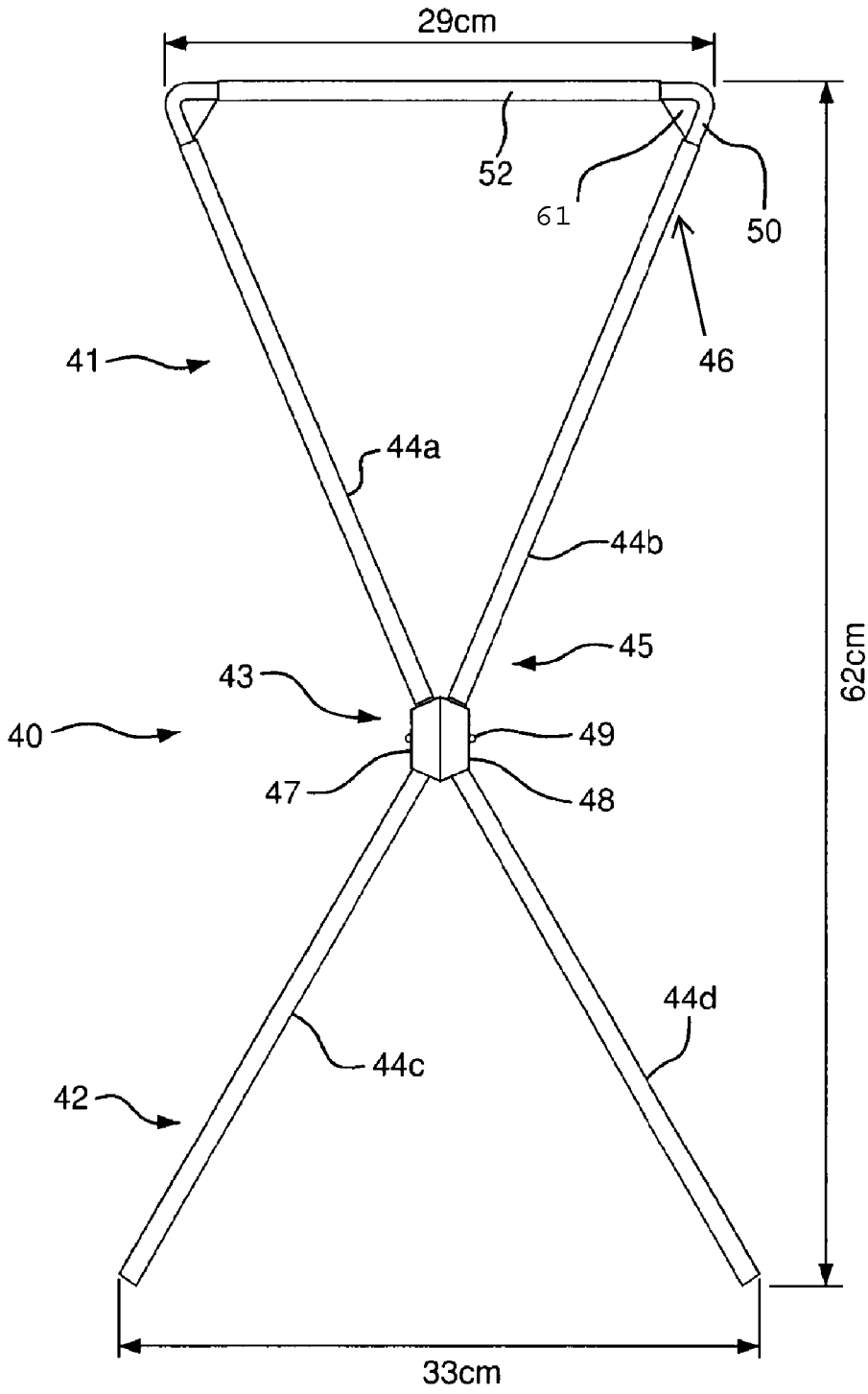
FIG. 4 provides a front view of one embodiment of the backpack suspension system.
Figure 5:
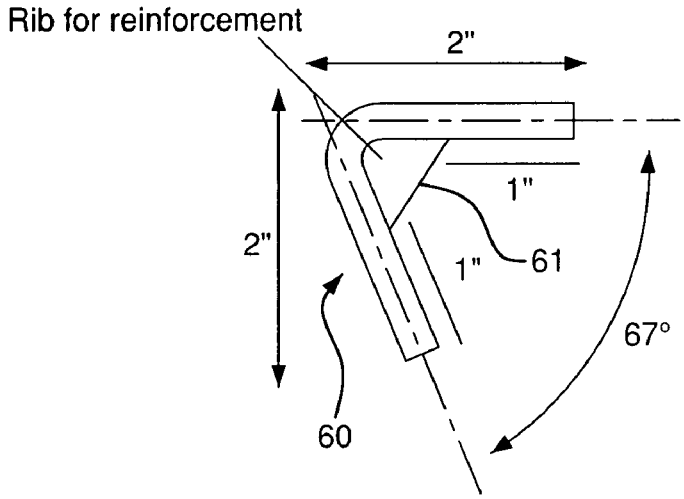
FIG. 5 provides a plan view of an optional connector piece.

FIG. 4 provides a front view of one embodiment of the backpack suspension system. This orientation would be against the user's back. Referring to FIG. 4, a backpack suspension system comprises a substantially X shaped frame 40 having an upper portion 41 and a lower portion 42 and a hub 43 connecting said upper and lower portions. The upper and lower portions comprise a plurality of rods 44*a-d*, each rod having a proximal end 45 and distal end 46. The proximal end 45 of each of the plurality of rods is adapted to rotate within the hub. In a preferred embodiment, the hub is comprised of a first member 47 and a second member 48 mated together with a pin 49 to allow the hub to pivot around a horizontal axis. In certain embodiments, a connector piece 50 connects a plurality of rods 44*a* and 44*b* of an upper portion 41 to a head piece 52. Referring to FIG. 5, connector piece 60 may also comprise a rib 61 for reinforcement.

Figure 7:
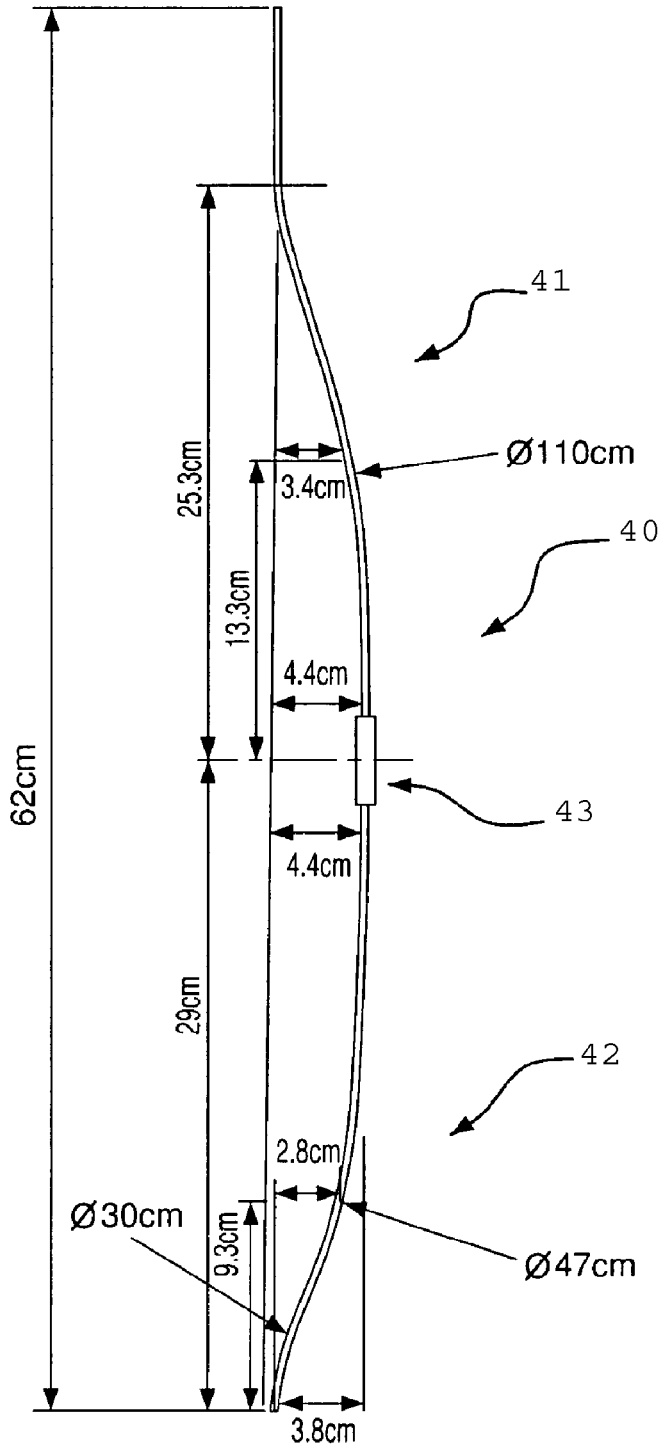
FIG. 7 provides a side view of one embodiment of the backpack suspension system.

In certain embodiments, each of the plurality of rods has a linear profile and a curved profile. For example as shown in FIG. 7, when viewed from the side, the plurality of rods have a profile curved to roughly match the curvature of a human spine, however when viewed from the front as seen in FIG. 4, the rods also have a substantial linear profile (when viewed from the back or front of the backpack suspension system).

In certain embodiments, the plurality of rods may have two curved profiles. In addition to being curved to roughly match the curvature of a human spine (when viewed from the side), the rods may be curved (when viewed from the back or front). See FIGS. 8*a*-8*d* for exemplary curved profiles of a plurality of rods 90, 91, 92, 100 and 101.

As discussed above, in certain embodiments the hub may be X-shaped, and in other embodiments the hub may be any other shape desired. For example, the hub may be, but is not limited to, a rectangular hub 200, an oval hub 201, a hexagonal hub 202, a diamond shaped hub 203, and a circular hub 204. See FIGS. 9*a*-9*e*, respectively.

Figure 6:
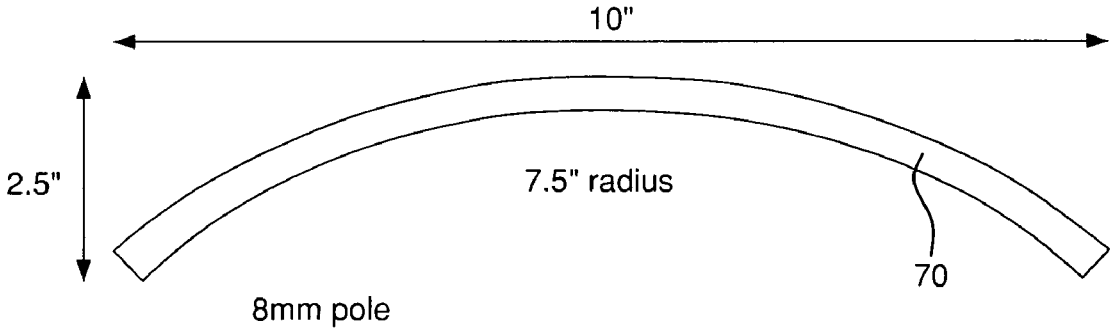
FIG. 6 provides a front view of an optional head piece.

Referring to FIG. 6, a preferred head piece 70 is shown. The head piece is shown as a rod with a curved profile (when viewed from the front or back), which provides headspace for the user's head. The head piece may be any other shape or profile as preferred to provide suitable headspace.

Figure 14:
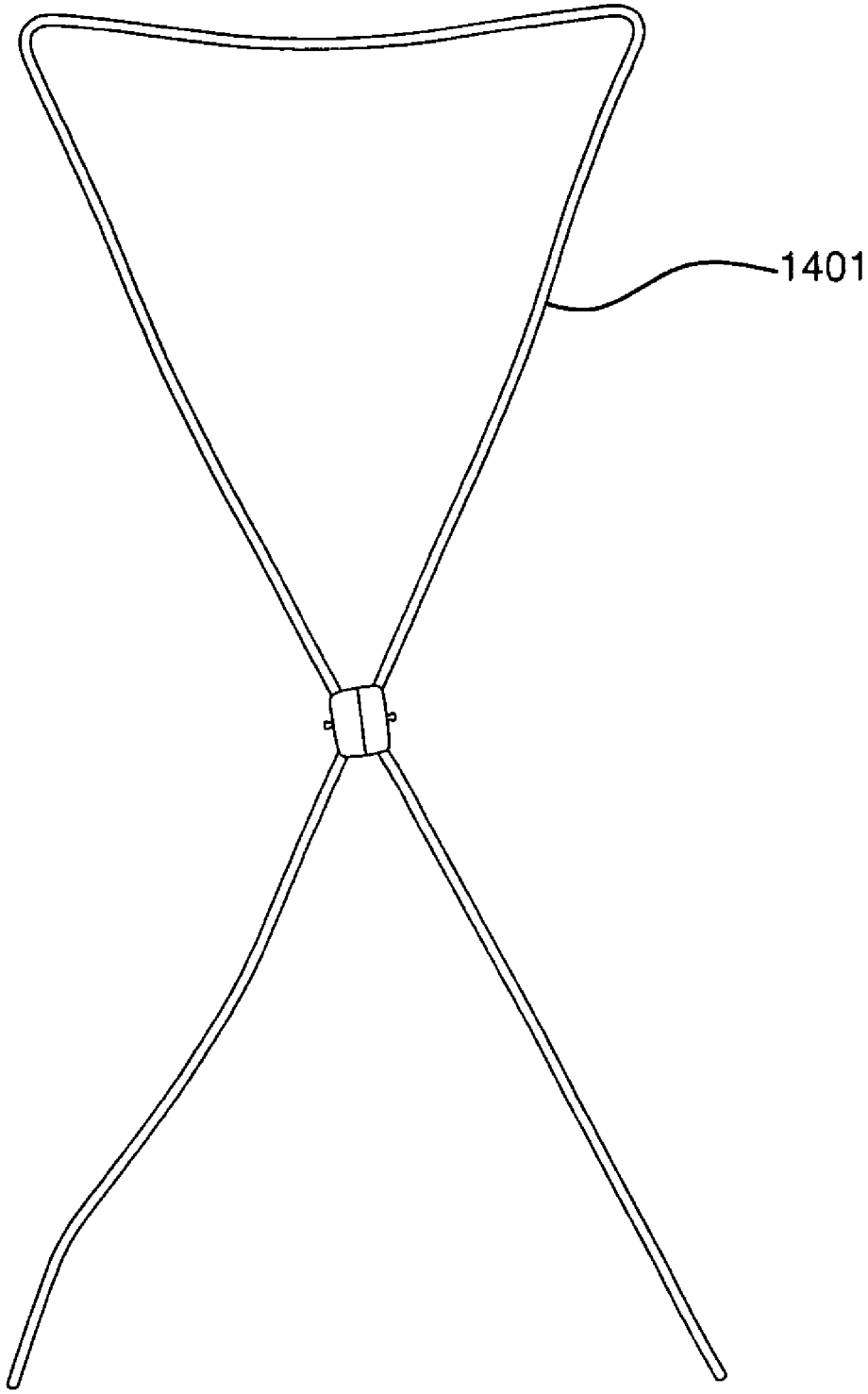
FIG. 14 shows an exemplary backpack suspension system.
Figure 15:
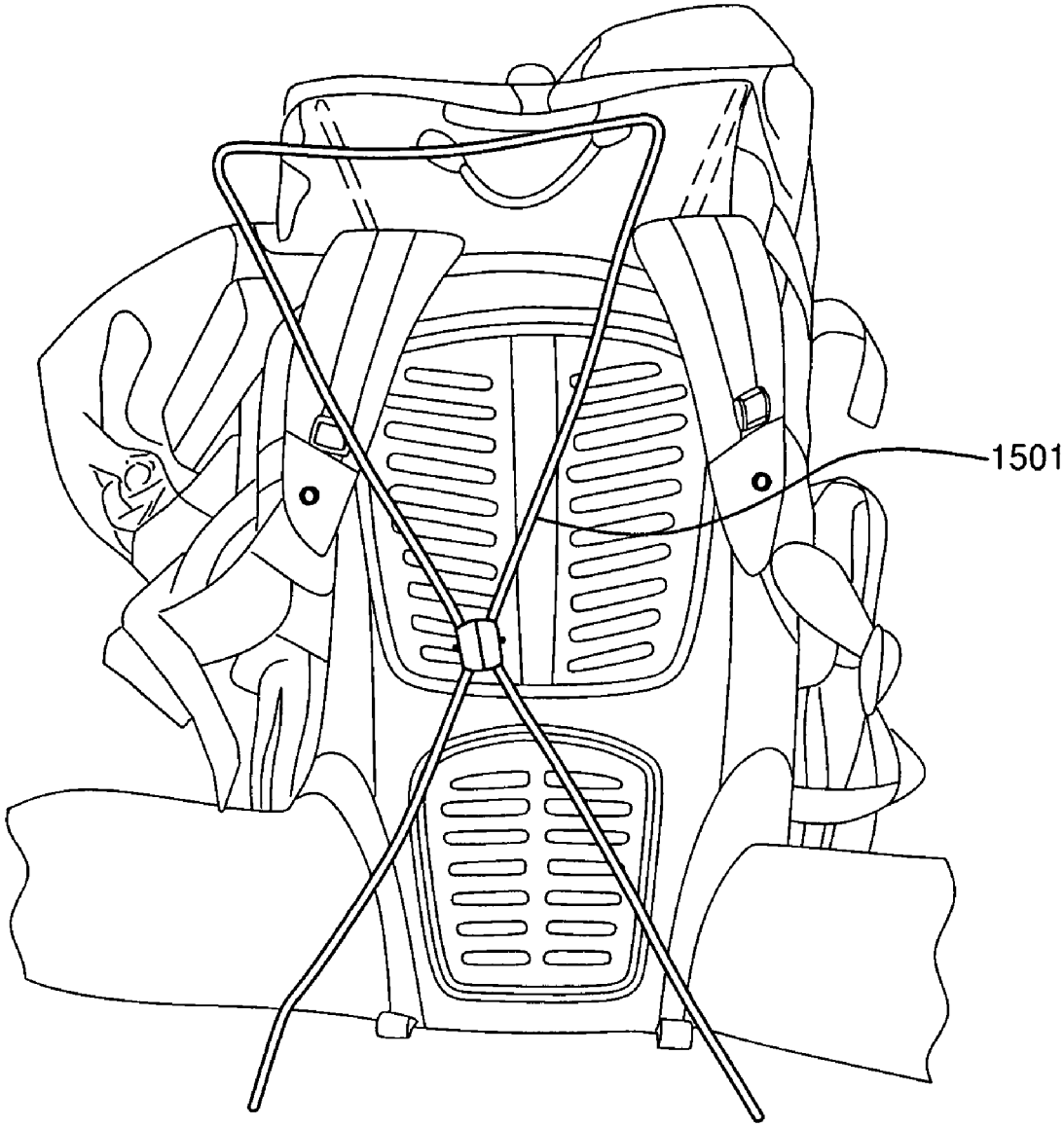
FIG. 15 shows an exemplary backpack suspension system with a backpack.

Backpack suspension systems of the present invention are particular useful in backpacks for hiking or mountaineering. Accordingly, another embodiment of the invention provides a backpack for hiking comprising a bag portion, a backpack suspension system described above integrated within the bag portion, a plurality of shoulder straps each attached to the bag portion, and a hip belt attached to the bag portion. FIGS. 10-13 show a backpack comprising a backpack suspension system 1001, 1101, 1201, 1301 of the present invention. In these examples, it can be seen that the plurality of rods of the suspension system may attach to various portions of the backpack. For example, attachment points may include, but are not limited to, an attachment point for a rod(s) may be provided in the lower corner of the backpack and rest behind the hip belt, attachments points may include pockets of material that can be fashioned to house a rod(s), and/or an attachment point for a rod(s) may be provided in the upper portion of the backpack suspension system such as via a pouch of webbing and nylon material. FIG. 14 shows an exemplary backpack suspension system 1401. FIG. 15 shows an exemplary backpack suspension system 1501 prior to installation within the backpack.

In addition to being useful in backpacks for hiking, backpack suspension systems of the present invention may of course be adapted to be used with any container carried on an individual's back. For example, backpack suspension systems of the present invention may be used with containers rigged to carry items such as oxygen bottles (i.e. for firefighters, emphysema patients, etc.), canister vacuum cleaners, hydration systems (i.e. bladders containing water or electrolyte replacements liquids), bottles or containers of other gases or fluids such as herbicides, pesticides, etc., or for other backpack-type containers used for other purposes.

The figures are only illustrative and are not meant to limit the scope of the invention in any way.

The invention claimed is:

1. A backpack comprising:

a bag portion adapted to be carried on a user's back;

at least one shoulder strap; and a backpack suspension system comprising:

a frame having an upper and a lower portion, and a substantially X shaped hub connecting said upper and lower portion, said hub adapted to pivot along a horizontal axis, said upper and lower portion each comprising a plurality of rods, each rod having a proximal and distal end, said proximal end of each of said plurality of rods adapted to rotate within said hub.

2. The backpack suspension system of claim 1, wherein the substantially X shaped hub is substantially centrally located between said upper and lower portions.

3. The backpack suspension system of claim 1, wherein the plurality of rods are comprised of 7001 T6 aluminum.

4. The backpack suspension system of claim 1, wherein said plurality of rods have a linear profile and a curved profile.

5. The backpack suspension system of claim 4, wherein said curved profile mimics the curvature of a human spine.

6. The backpack suspension system of claim 1, further comprising a head piece and a connector connecting the plurality of rods of said upper portion to the head piece.

7. The backpack suspension system of claim 6, wherein the connector piece further comprises a support rib for reinforcement.

8. The backpack suspension system of claim 1, wherein the hub comprises two members mated together with a pin adapted to allow pivoting of said two members around a horizontal axis.

9. The backpack suspension system of claim 8, wherein the pin is slip fitted to provide rotation of the hub around the pin.

10. A backpack comprising:

a bag portion adapted to be carried on a user's back;

at least one shoulder strap; and a backpack suspension system comprising:

a substantially X shaped frame having an upper and a lower portion, and a hub connecting said upper and lower portion, said hub having an upper angled portion and a lower angled portion, said hub adapted to pivot about a horizontal axis, said upper and lower portion each comprising a plurality of rods, each rod having a proximal and distal end, said proximal end of each of said plurality of rods adapted to rotate within said hub, wherein the upper angled portion receives the proximal ends of the plurality of rods of the upper portion at a first angle from the horizontal axis and the lower angled portion receives the proximal ends of the plurality of rods of the lower portion at a second angle from the horizontal axis, wherein the first angle and the second angle are different.

11. The backpack suspension system of claim 10, wherein the hub is X-shaped and substantially centrally located between said upper and lower portions.

12. The backpack suspension system of claim 10, wherein the plurality of rods are comprised of 7001 T6 aluminum.

13. The backpack suspension system of claim 10, wherein the plurality of rods of the upper portion comprises two rods, and the plurality of rods of the lower portion comprises two rods.

14. The backpack suspension system of claim 10, wherein said plurality of rods have a linear profile when viewed from a front or back of the system and a curved profile when viewed from the side of the system.

15. The backpack suspension system of claim 14, wherein said curved profile mimics the curvature of a human spine.

16. The backpack suspension system of claim 10, further comprising a head piece and a connector connecting the plurality of rods of said upper portion to the head piece.

17. The backpack suspension system of claim 16, wherein the connector piece further comprises a support rib for reinforcement.

18. The backpack suspension system of claim 10, wherein the hub comprises two members mated together with a pin adapted to allow pivoting of said two members around a horizontal axis.

19. The backpack suspension system of claim 18, wherein the pin is slip fitted to provide rotation of the hub around the pin.

20. A backpack comprising:

a bag portion adapted to be carried on a user's back;

at least one shoulder strap; and a backpack suspension system comprising:

a frame having an upper and a lower portion, and a hub connecting said upper and lower portion, said hub comprising two members mated together with a pin, said two members adapted to pivot relative to each other about a horizontal axis, said upper and lower portion each comprising a plurality of rods having a linear profile and a curved profile, each rod having a proximal and distal end, said proximal end of each of said plurality of rods adapted to rotate within said hub.

21. The backpack suspension system of claim 20, wherein the hub is substantially centrally located between said upper and lower portions.

22. The backpack suspension system of claim 20, wherein said curved profile mimics the curvature of a human spine.

23. The backpack suspension system of claim 20, wherein said proximal end of at least two rods are connected to the hub on a face that does not contain the pin.

24. The backpack suspension system of claim 20, wherein the pin is slip fitted to provide rotation of the hub around the pin.

25. The backpack suspension system of claim 20, wherein the plurality of rods are comprised of 7001 T6 aluminum.

26. The backpack suspension system of claim 20, wherein the plurality of rods of the upper portion comprises two rods each extending from the hub at an angle of about 67 degrees from the horizontal axis.

27. The backpack suspension system of claim 20, wherein the plurality of rods of the lower portion comprises two rods each extending from the hub at an angle of about 60 degrees from the horizontal axis.

28. The backpack suspension system of claim 20, further comprising a head piece and a connector connecting the plurality of rods of said upper portion to the head piece.

29. The backpack suspension system of claim 28, wherein the connector piece further comprises a support rib for reinforcement.

* * * * *